US006739775B2

(12) United States Patent
Van Soest et al.

(10) Patent No.: US 6,739,775 B2
(45) Date of Patent: May 25, 2004

(54) APPARATUS FOR POSITIONING RECEIVING MATERIAL DURING THE APPLICATION OF AN INK IMAGE THERETO

(75) Inventors: Hendrikus Johannes Joseph Van Soest, Helden (NL); Andreas Cornelis Stoot, Venlo (NL); Marius Petrus Josef Johannes Robertus Ponten, Lierop (NL); Marco Herman Laurens Hubert Kusters, Limbricht (NL)

(73) Assignee: Océ-Technologies B.V., Venlo (NL)

( * ) Notice: Subject to any disclaimer, the term of this patent is extended or adjusted under 35 U.S.C. 154(b) by 161 days.

(21) Appl. No.: 09/779,740

(22) Filed: Feb. 9, 2001

(65) Prior Publication Data

US 2001/0020959 A1 Sep. 13, 2001

(30) Foreign Application Priority Data

Feb. 10, 2000 (NL) ..... 1014351

(51) Int. Cl.[7] ..... B41J 11/42

(52) U.S. Cl. ..... 400/579; 400/578; 347/104; 271/194

(58) Field of Search ..... 400/578, 579, 400/627, 645; 271/3.07, 3.22, 4.01, 5, 11, 20, 90–102, 104, 194, 276; 347/104

(56) References Cited

U.S. PATENT DOCUMENTS 6,152,444 A * 11/2000 Elgee et al. ..... 271/266
6,179,285 B1 * 1/2001 Teumer et al. ..... 271/194
6,234,472 B1 * 5/2001 Juan ..... 271/194
6,270,215 B1 * 8/2001 Miyasaka et al. ..... 347/104
6,367,999 B1 * 4/2002 Juan et al. ..... 400/645
6,517,179 B2 * 2/2003 Hinojosa et al. ..... 347/16

FOREIGN PATENT DOCUMENTS

| | | | | |
|---|---|---|---|---|
| DE | 19901994 | | 7/1999 | |
| EP | 0699537 | | 3/1996 | |
| GB | 2290753 | | 1/1998 | |
| JP | 08156351 A | * | 6/1996 | ..... B41J/11/02 |
| JP | 09220837 A | * | 8/1997 | ..... B41J/13/22 |
| JP | 11208045 | | 8/1999 | |

* cited by examiner

*Primary Examiner*—Minh Chau
(74) *Attorney, Agent, or Firm*—Birch, Stewart, Kolasch & Birch LLP

(57) ABSTRACT

Apparatus for keeping a receiving material flat against a plate during the application of an ink image thereto, wherein the plate is provided with V-shaped channels which extend in the direction in which the receiving material is movable stepwise over the plate. Ribs which separate the channels from one another are provided with suction openings in order to draw, by negative pressure, bubbles which have been formed by moisture absorption in the receiving material, into the channels in order to prevent the bubbles from coming into contact with ink application means movable over the plate. The outermost channels are provided with suction openings in the channel walls in order to keep wrinkles and corrugations at the sides of the receiving material out of contact with the ink application means.

7 Claims, 5 Drawing Sheets

APPARATUS FOR POSITIONING RECEIVING MATERIAL DURING THE APPLICATION OF AN INK IMAGE THERETO

BACKGROUND OF THE INVENTION

The present invention relates to apparatus for applying an ink image to a receiving material adapted to be moved in an advancing direction, comprising an ink application mechanism for applying an ink image to a strip of receiving material which extends in a direction transverse to the advancing direction of the receiving material and carrier means are provided to keep the strip in a predetermined position with respect to the ink application mechanism, whereby the carrier means comprises a carrier plate for carrying said strip, said carrier plate having channels extending in a direction parallel to the direction of advance of the receiving material.

An apparatus of this kind is known from UK Patent Specification 2 290 753. In the apparatus described therein, the channels in the carrier plate are formed by ribs disposed on the carrier plate. Bubbles formed in the receiving material by the absorption of moisture-containing constituents of the ink and the receiving material can sag by gravity, in the channels which formed in order to avoid contact between the receiving material and an ink application mechanism situated a short distance thereabove and formed by ink heads.

A disadvantage of this known apparatus is that bubbles forming in the receiving material, at places where the receiving material lies on the ribs, can hardly sag in the channels, with the consequent risk that the receiving material may nevertheless still come into contact with the ink heads, thus resulting in undesirable soiling of receiving material and ink heads.

SUMMARY OF THE INVENTION

Accordingly, the main object of the present invention is to provide an apparatus which does not contain this disadvantage.

To this end, according to the present invention, the carrier plate is provided with holes and air displacement means are provided which draw air via said holes away from the space between the carrier plate and a strip of receiving material lying on the carrier plate, said holes appearing in the carrier plate at least in a portion thereof in which a strip of the receiving material is maintained in a predetermined position with respect to the ink application mechanism.

As a result, the receiving material is pulled against the carrier plate with a relatively considerable force so that it is possible to ensure, with a great degree of certainty, that parts of the receiving material, particularly bubbles projecting in the direction of the ink application mechanism, remain out of contact with the ink application mechanism. Another effect is that no contact pressure means are required to press the receiving material into the recessed parts of the carrier plate (as known from the European Patent 0 699 537, which also relates to an apparatus according to the preamble), which contact pressure means might obstruct the advance of receiving material and be inoperative at the location of the ink application mechanism.

Preferably, the holes are formed in the ribs forming the channels on the carrier plate and lead into the top surface of each rib. The effect of this is that when the receiving material is used which is not sensitive to the formation of bubbles or other types of deformation, it is pulled flat against the ribs of the carrier plate without parts of the material extending between the ribs being appreciably pulled into the channels and thus, the receiving material remains sufficiently flat during the application of an ink image.

Another effect is that when receiving material is used which is sensitive to deformation, such as bubbles and creases, said material is satisfactorily drawn against the ribs and the negative pressure also forms in the channels between the ribs due to the leakage of air between the holes and receiving material, and said negative pressure pulls the bubbles and creases into the channels in order to keep them away from the ink application mechanism.

Preferably, each channel has a width of between 15 and 20 mm. If the channels have a width less than 12 mm it has been found that the effect is inadequate because the carrier plate then behaves like a practically completely flat plate with bubbles which project in the direction of the ink application mechanism not being drawn into the channels. If the channel width is greater than 20 mm, receiving material which is unaffected by deformation will undergo deformation unnecessarily due to sagging in the wide channels.

If the channels are configured with walls which form an acute angle with the top surface of the carrier plate, then the side edges of a web of receiving material fed over the carrier plate can slide easily over the carrier plate in the transverse direction in the event of skewing and expansion without catching or curling.

If the holes in the carrier plate, as considered in the direction of advance of the receiving material are situated predominantly in an upstream edge portion, then if the said zone is covered solely by a leading part of a web of receiving material, sufficient suction is obtained because leakage air remains substantially absent in the rest of the carrier plate.

According to another aspect of the invention, the holes extend in edge zones of the carrier plate where side edges of receiving material for processing can come into contact with the carrier plate, and, as considered in the direction of advance of the receiving material, over the entire length of the carrier plate. The effect of this is that the side edges of receiving material which are extra sensitive to creasing are kept flat so that ink heads moving in reciprocation in the transverse direction do not collide with these side edges.

BRIEF DESCRIPTION OF THE DRAWINGS

Other features and advantages of the invention will be explained hereinafter with reference to the accompanying drawings wherein.

DETAILED DESCRIPTION OF THE INVENTION

Figure 1:
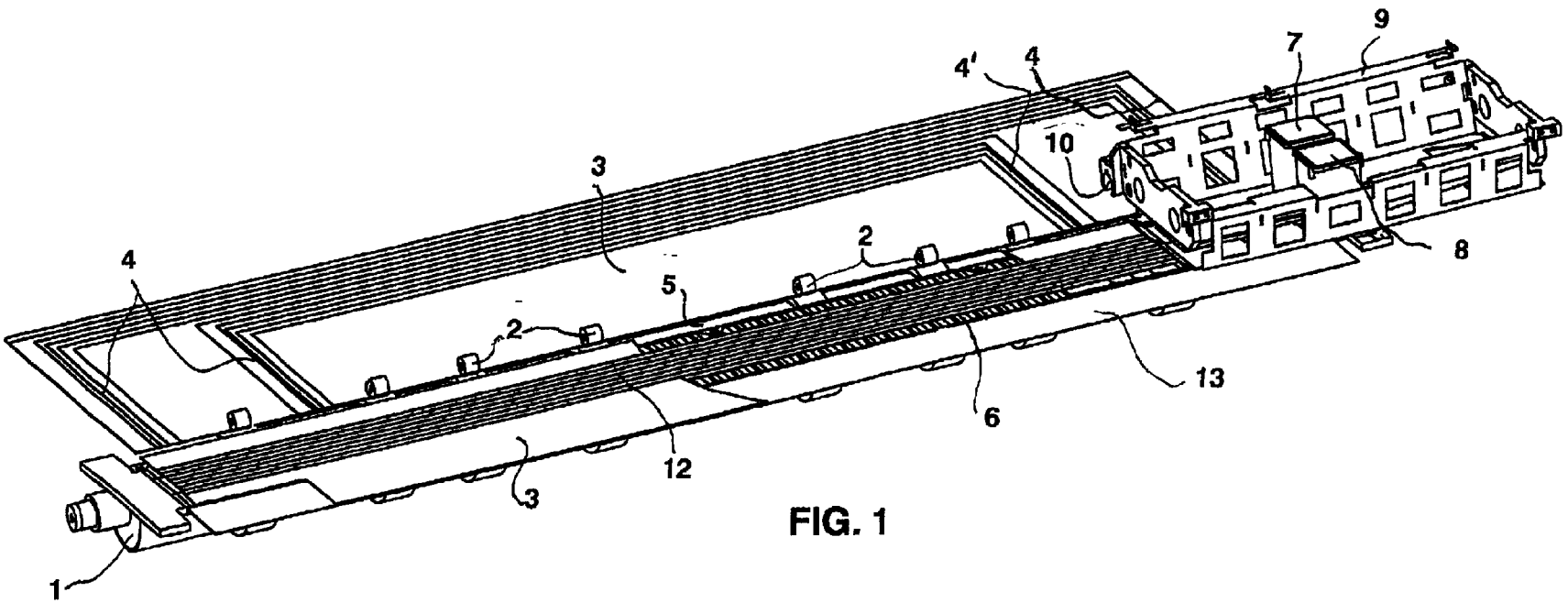
FIG. 1 is a perspective view of an apparatus according to the present invention.

The apparatus shown in FIG. 1 comprises a transport roller system 1 which forms transport nips 2 in a feed path for feeding receiving material 3 originating from a number of stock rolls (not shown). Roller system 1 is formed by a drivable roller with a diameter of about 80 mm and a number of soft rubber contact pressure rollers with a diameter of about 14 mm to provide a slip-free intermittent transport of the receiving material through the in-line transport nips 2.

Receiving material 3 may have different widths, the most usual of which are shown in FIG. 1, and is fed centrally so that the side edges 4 of the receiving material 3 can occupy the positions shown in FIG. 1. Side edges 4' are at a distance of about 600 mm from one another (for example for the supply of the A1 format in the longitudinal direction and the A2 format in the transverse direction and for the supply of 24" width receiving material) and the side edges 4" are at a distance of approximately 900 mm from one another (e.g. for the supply of the A1 format in the transverse direction and A0 format in the longitudinal direction and for the supply of 36" width receiving material). The feed path in which the transport nips 2 are situated is formed by guide-plate 5 over which the receiving material moves. Guide plate 5 is followed in the transport direction by a carrier plate 6 which forms a carrying surface for a part of the receiving material 3 for printing which is fed thereon.

Printing of a part of the receiving material 3 lying on the carrier plate 6 is effected by inkjet printheads, of which two 7 and 8 are shown in FIG. 1. The printheads are received in a carriage 9 provided with guide holes 10, by means of which the carriage 9 is movable over the carrier plate 6 in reciprocation via guide rods (not shown). In total, for example, ten printheads can be accommodated in the carriage 9, and each of the printheads can print one of eight adjacent strips 12 of a part of the receiving material 3 lying on the carrier plate 6. By advancing the receiving material 3 over a short distance corresponding to the width of the strips 12 between two reciprocating movements of the carriage 9, a multi-color ink image can be applied to the receiving material 3 in a known manner with the printheads each containing a different color ink. Each of the strips 12, for example, has a width of about 8 mm, resulting in a total distance of 8×8 mm=64 mm over which the receiving material should lie in a flat state beneath the printheads.

After printing, the printed part of the receiving material 3 is fed to a delivery plate 13 which in the transport direction follows the carrier plate 6, whereafter a printed sheet is cut off the receiving material 3 by a cutting device (not shown) disposed downstream of the delivery plate 13, whereafter the printed sheet is fed out of the apparatus.

In order that the web of receiving material 3 from which a printed sheet has been cut off can be printed from the now leading edge, the transport roller system 1 pulls the receiving material 3 back on to the carrier plate 6. On the subsequent printing of receiving material 3 in a different width, the receiving material still in the feed path is pulled back still further to a position in front of the transport roller system 1, for example by re-winding receiving material onto its stock roll, and the receiving material of a different width is fed from a different stock roll.

The above description of the general arrangement of an apparatus in which the invention to be described hereinafter can be applied is considered sufficient for an understanding of the environment in which the steps according to the present invention can be applied.

Figure 2:
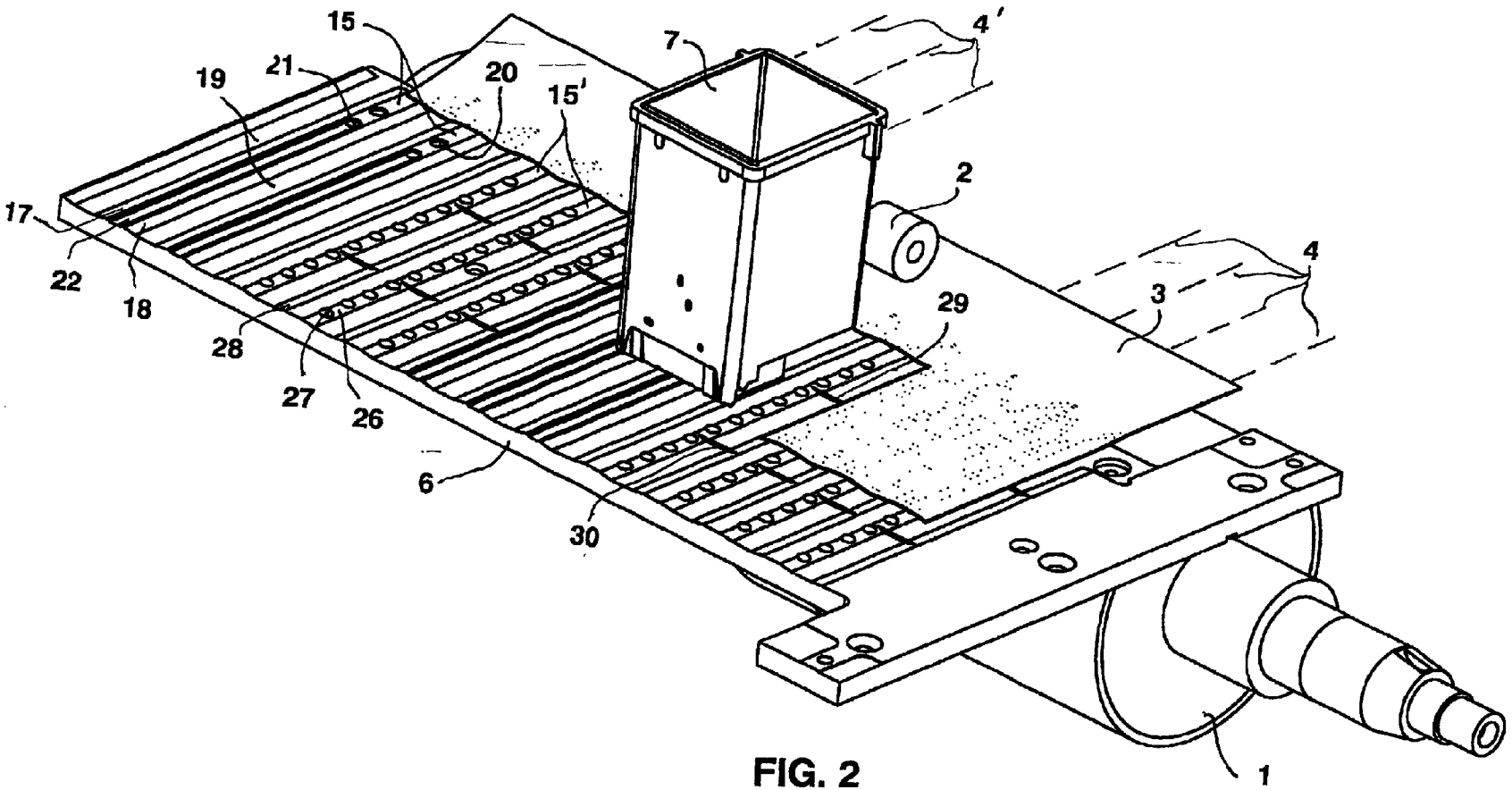
FIG. 2 is a top plan view of the apparatus shown in FIG. 1.
Figure 3:
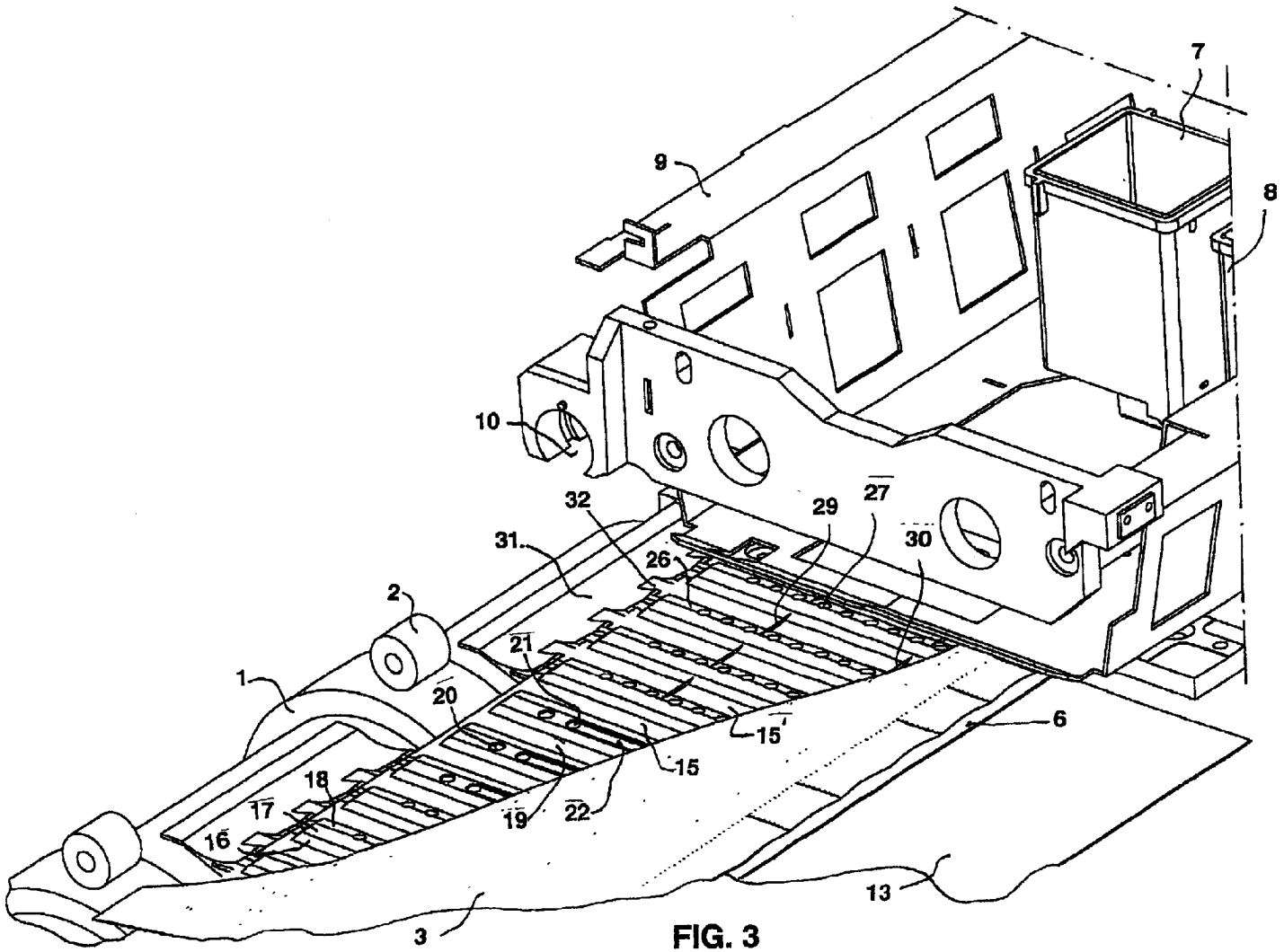
FIG. 3 is a detail of the apparatus shown in FIGS. 1 and 2.

As shown generally in FIG. 1 and in greater detail in FIGS. 2 and 3, the carrier plate 6 has a profiled form consisting of V-shaped ribs 15 which extend parallel to the direction of advance of receiving material 3 over the carrier plate 6. The distance between the ribs is 18 mm. Each rib 15 is formed by a top surface 16 of a width of approximately 5 mm, which top surfaces 16 lie in a plane which extends at a short distance of, for example, 1.2 mm beneath the underside of the print carriage 9.

The side walls 17 and 18 of the ribs 15 form an angle of 170° with the top surface 16 of the ribs 15. Channels 19 having a depth of approximately 1.0 mm are, thus formed between the ribs 15. These channels 19 serve to prevent contact between a receiving material 3 on the carrier plate 6, which curls up locally due to moisture absorption during printing with aqueous ink in particular, and a print carriage 9 moving in reciprocation over the receiving material 3. Any bubbles above the channels 19 can sag therein.

In order to ensure that bubbles situated just above the top surface 16 of a rib 15 and projecting upwardly does not come into contact with the print carriage 9, the receiving material 3 should not project appreciably above the top surface 16. To this end, according to the present invention, holes 20 and 21 are formed in the carrier plate 6 at the top surface 16 of each rib 15 and are connected beneath the carrier plate 6 to an air chamber in which a negative pressure of, for example, 200–300 pascal is maintained by means of a fan.

The holes 20 and 21 are disposed on the upstream side of each rib 15 so that receiving material which by its leading edge covers only the most upstream strip 12 also covers the holes 20 and 21. As a result, a relatively considerable negative pressure acts on the leading edge of the supplied receiving material 3 in order to draw said edge flat against the carrier plate 6. This is important in order to pull flat a receiving material leading edge which is curled due to the action of moisture. If the suction openings were provided over the entire length of each rib, the effective suction force on the leading edge would be considerably reduced due to leakage air.

As clearly shown in FIG. 3, a shallow groove 22 is formed in the top surface 16 of the ribs 15 outside the zones of the carrier plate 6 where side edges 4' and 4" of the supplied receiving material 3 are situated the groove extends from hole 21 to the upstream edge of the associated rib 15. When there is a negative pressure in the hole 21, and when groove 22 is covered by receiving material 3, a negative pressure will also form in grooves 22 by the intake of air and this negative pressure ensures that receiving material is pulled against the top surfaces 16 with a force such that the receiving material comes into contact therewith with any bubbles present in the receiving material being pulled away. However, this contact is not so intimate, so that air can be drawn out of the channels 19 through the minuscule passages still remaining between the top surface 16 and the receiving material 3, certainly in the case of completely flat receiving material. Thus a negative pressure is also formed in the channels 19, which locally pulls the receiving material down to prevent, in particular, upwardly directed bubbles, in the receiving material from coming into contact with the print carriage 9.

Figure 4:
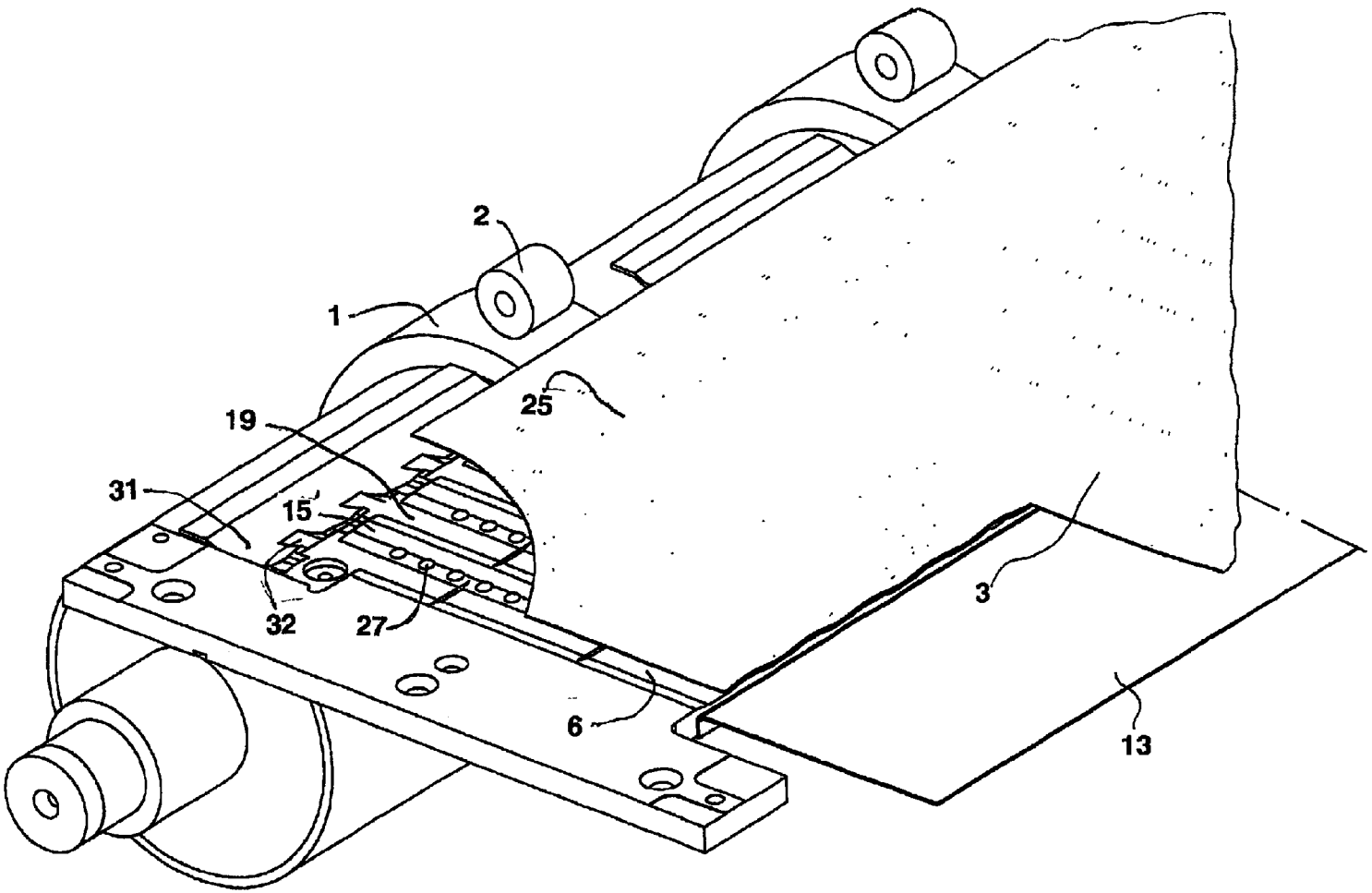
FIG. 4 shows the behavior of receiving material in the apparatus of the present invention and FIG. 5 shows the behavior of a side edge of the receiving material in the apparatus of the present invention.
Figure 5:
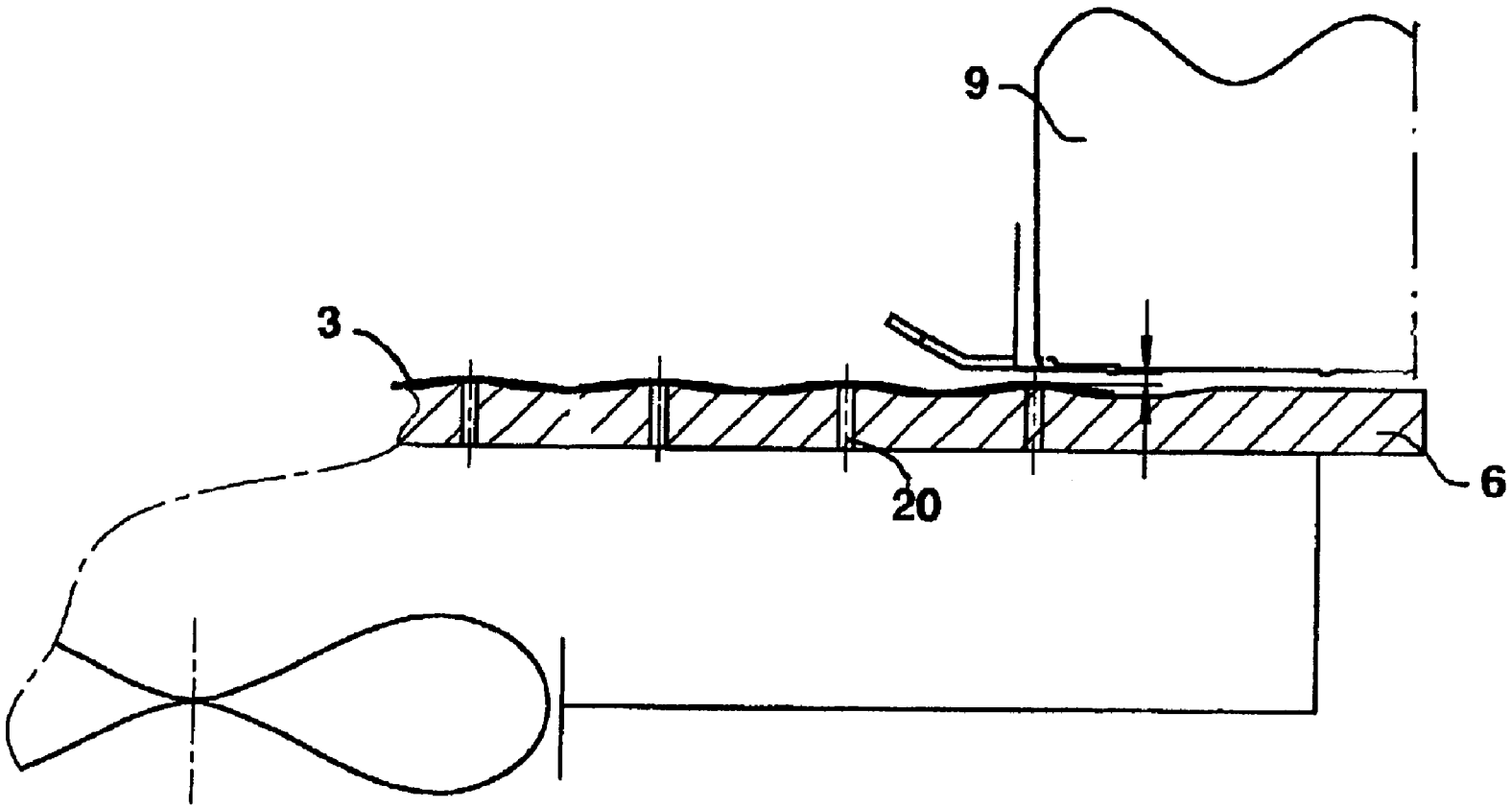

FIGS. 2 and 4 show how the receiving material is, to some extent, pulled into the channels 19. The formed waves 25 terminate at the downstream side of the carrier plate 6 past the latter at the flat delivery plate 13. As a result of contact between receiving material 3 and the delivery plate 13 downstream of these waves 25 an air seal forms which prevents the negative pressure beneath the receiving material from being excessively affected by leaking air.

Another aspect of the present invention will now be described. Due to various reasons, the side edges of supplied receiving material are extra sensitive to changes of shape. These are manifest in particular in the formation of wrinkles which extend transversely of the direction of advance of the receiving material from the side edges to some distance therefrom. These wrinkles may arise due to moisture absorption in a damp environment. Particularly in the case of rolled material, the side edges, in particular, will absorb moisture and irregularly expand causing corrugated edges. However, moisture absorption during printing with aqueous inks also plays an important part in the formation of side wrinkles. To control these wrinkles and corrugations, according to the present invention the application of suction to receiving material is made stronger in the zones of the side edges 4' and 4" of receiving material than in other zones of the latter. To this end, in the embodiment described here, the outer four ribs where side edges 4" are situated and three ribs 15' situated inwardly at a distance of three ribs therein, in which side edges 4' are situated, are constructed as shown in FIG. 3. In the ribs in question, no holes 20 and 21 and groove 22 are formed in the top side 16. Holes 27 are formed in the oblique walls 26 of each associated rib situated most inward, and are regularly distributed over the entire length of said wall 26 and are connected to a negative pressure chamber beneath carrier plate 6. The positioning of these holes 27 guarantees that the side edges of receiving material will be pulled down properly in the channel where said side edge is situated over the entire length of the channel. If suction openings were located in the base of the associated channel or in the wall 28 opposite wall 26, receiving material would not be properly drawn into contact between the outermost rib and the material edge if the side edge of receiving material were situated between the suction openings and the outermost rib over which the receiving material lies.

Partitions 29 and 30 are disposed between the walls 26 and 28 of the channels in which there are holes 27 and divide the associated channel into three approximately equal parts as considered in the longitudinal direction of the channel.

The partitions 29 and 30 extend in a direction extending transversely of the direction of advance of receiving material 3 over the carrier plate 6 and have a height of about half the channel height. The partitions 29 and 30 form supporting points for a receiving material drawn through holes 27 in the channel and thus prevent the nuisance of a whistling sound as a result of the vibration of receiving material drawn against the surface 26 due to airflow between the receiving material and the channel wall in the direction of holes 27. Such vibration is effectively suppressed by partitions 29 and 30.

As a result of the side edges of receiving material 3 being drawn against the carrier plate 6, any wrinkles in the receiving material 3 are locally eliminated. However, there is a risk that wrinkles will form at the side edges of receiving material situated upstream and downstream of the carrier plate 6. To prevent these wrinkles from extending upwards and thus being able to come into contact with the respectively upstream and downstream sides of the print carriage 9, gutters 31 shown in FIGS. 3 and 4 are formed in the guide plate 5 and extend transversely over the zone of the channels which are arranged for applying suction to the side edges of the receiving material fed over the carrier plate 6. Similar gutters are formed in the delivery plate 13 situated downstream of carrier plate 6. Gutters 31 are connected via connecting ducts 32 to the channels arranged for applying suction to the side edges of the receiving material 3. Thus air is drawn from the gutters 31 to ensure that any transverse wrinkles formed locally in the receiving material is pulled down in order thus to avoid interaction with the print carriage 9.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for applying an ink image to a receiving material which is adapted to be advanced in a predetermined direction which comprises an ink application mechanism for applying an ink image to a strip of receiving material, said ink application mechanism extending in a direction transverse to the direction of advance of the receiving material such that a print range is provided; and carrier means for keeping said strip in a predetermined position with respect to the ink application mechanism, said carrier means comprising a carrier plate for carrying said strip, said plate having channels extending in a direction substantially parallel to the direction of advance of the receiving material, said channels having channel walls which define an acute angle with a tip surface of the carrier plate wherein the carrier plate is provided with holes and air displacement means operatively associated with said holes for drawing air via said holes away from the space between the carrier plate and the strip of receiving material lying on the carrier plate said holes being provided in the carrier plate in a portion thereof which corresponds to said print range.

2. The apparatus according to claim 1, wherein each channel has a width of between about 15 and 20 mm.

3. The apparatus according to claim 1, wherein the holes, when considered in the direction of advance of the receiving material, are situated predominantly at an upstream edge portion of the carrier plate.

4. An apparatus for applying an ink image to a receiving material which is adapted to be advanced in a predetermined direction which comprises an ink application mechanism for applying an ink image to a strip of receiving material, said ink application mechanism extending in a direction transverse to the direction of advance of the receiving material such that a print range is provided; and carrier means for keeping said strip in a predetermined position with respect to the ink application mechanism, said carrier means comprising a carrier plate for carrying said strip, said plate having channels extending in a direction substantially parallel to the direction of advance of the receiving material, wherein the carrier plate is provided with holes and air displacement means operatively associated with said holes for drawing air via said holes away from the space between the carrier plate and the strip of receiving material lying on the carrier plate, said holes being disposed in ribs which form the channels and lead into the top surface of each rib, wherein the top surface of each rib is formed with a groove which extends from a hole provided in said rib to a downstream edge of the carrier plate.

5. An apparatus for applying an ink image to a receiving material which is adapted to be advanced in a predetermined direction which comprises an ink application mechanism for applying an ink image to a strip of receiving material, said ink application mechanism extending in a direction transverse to the direction of advance of the receiving material such that a print range is provided; and carrier means for keeping said strip in a predetermined position with respect to the ink application mechanism, said carrier means comprising a carrier plate for carrying said strip, said plate having channels extending in a direction substantially parallel to the direction of advance of the receiving material, wherein the carrier plate is provided with holes and air displacement means operatively associated with said holes for drawing air via said holes away from the space between the carrier plate and the strip of receiving material lying on the carrier plate, said holes being provided in the carrier plate in a portion thereof which corresponds to said print range, and wherein the carrier plate contains edge zones where side edges of a web of receiving material for processing may come into contact with the carrier plate, and wherein the holes, in the edge zones are formed in the channel walls which are situated on that side of the channels which is closest to the middle of the carrier plate, and when considered in the direction of advance of the receiving material, extend over the entire length of the carrier plate.

6. The apparatus according to claim 5, wherein partitions are disposed in each channel in the edge zones at regular intervals from one another and extend transversely over the channel and their top is situated beneath the top edge of said channel.

7. The apparatus according to claim 6, wherein gutters are formed on the upstream and downstream sides of the edge zones and extend transversely with respect to the direction of advance of the receiving material and are in open communication with the channels in said edge zones.

* * * * *